US006375092B1

(12) United States Patent
Banach

(10) Patent No.: US 6,375,092 B1
(45) Date of Patent: Apr. 23, 2002

(54) WEIGHTED DRINKING APPARATUS

(76) Inventor: Wallace Franklin Banach, 6042 Edsall Rd. Apt. 304, Alexandria, VA (US) 22304

( * ) Notice: Subject to any disclaimer, the term of this patent is extended or adjusted under 35 U.S.C. 154(b) by 0 days.

(21) Appl. No.: 09/766,599

(22) Filed: Jan. 23, 2001

Related U.S. Application Data

(63) Continuation-in-part of application No. 09/670,816, filed on Sep. 28, 2000, now abandoned.

(51) Int. Cl.[7] ..... A47G 21/18

(52) U.S. Cl. ..... 239/33; 222/464.4; 215/389; 220/705

(58) Field of Search ..... 239/24, 33; 222/464.4; 215/229, 388, 389, 11.1, 11.4; 229/103.1; 220/705, 706; 426/85; 138/109, 114, 178

(56) References Cited

U.S. PATENT DOCUMENTS

| | | | | |
|---|---|---|---|---|
| 214,617 | A | | 4/1879 | Brown |
| 942,306 | A | | 12/1909 | Clarke |
| 1,253,579 | A | | 1/1918 | Deanes |
| 1,293,850 | A | | 2/1919 | Mathis |
| 1,309,994 | A | | 7/1919 | McAuliffe |
| 1,710,163 | A | | 4/1929 | Hartney et al. |
| 1,735,144 | A | | 11/1929 | Tanner |
| 1,813,285 | A | | 7/1931 | Galetschky |
| 1,887,013 | A | * | 11/1932 | Coffield ..... 222/464.4 |
| 2,072,580 | A | | 3/1937 | Correll |
| 2,372,678 | A | * | 4/1945 | McKay ..... 222/464.4 |
| 2,530,583 | A | * | 11/1950 | Nurkiewicz ..... 222/464.4 |
| 2,613,107 | A | | 10/1952 | Hartnett |
| 2,613,988 | A | * | 10/1952 | Jarbeau ..... 239/33 |
| 3,088,680 | A | | 5/1963 | Fulton et al. |
| 3,099,565 | A | | 7/1963 | Neuhauser |
| 3,490,656 | A | | 1/1970 | Taschner |
| 3,547,296 | A | | 12/1970 | Greenberg |
| 3,580,430 | A | | 5/1971 | Angele |
| 3,908,690 | A | | 9/1975 | Shotmeyer |
| 4,273,272 | A | * | 6/1981 | Blanc ..... 222/464.4 |
| 4,699,318 | A | | 10/1987 | Donatello et al. |
| 4,830,235 | A | | 5/1989 | Miller |
| 4,909,437 | A | * | 3/1990 | Kang ..... 239/33 |
| 5,038,476 | A | | 8/1991 | McCrea |
| 5,148,971 | A | | 9/1992 | Ahn |
| 5,195,664 | A | | 3/1993 | Rhea |
| 5,215,227 | A | | 6/1993 | Farner |
| 5,636,770 | A | | 6/1997 | Hachinohe |
| 5,873,474 | A | * | 2/1999 | Gray ..... 222/464.4 |
| 5,934,519 | A | | 8/1999 | Kim et al. |
| 5,979,715 | A | | 11/1999 | Emrick |
| 6,056,149 | A | | 5/2000 | Murphy et al. |
| 6,056,206 | A | | 5/2000 | Whiton |
| 6,142,384 | A | * | 11/2000 | Shafik ..... 239/33 |

* cited by examiner

*Primary Examiner*—Steven J. Ganey
(74) *Attorney, Agent, or Firm*—Hall, Priddy, Myers, & Vande Sande

(57) ABSTRACT

A drinking apparatus which generally includes a drinking straw with a weight thereon for anchoring the drinking straw against the buoyancy of a carbonated beverage.

6 Claims, 2 Drawing Sheets

WEIGHTED DRINKING APPARATUS

This application is a Continuation-in-Part of U.S. patent application Ser. No. 09/670,816 filed Sep. 28, 2000, now abandoned, and entitled WEIGHTED DRINKING APPARATUS AND STORAGE FOR SAME and invented by Wallace Franklin Banach, the disclosure of which is hereby incorporated by reference.

FIELD OF THE INVENTION

This invention relates to a drinking straw which is provided with a weight in order to anchor the drinking straw against the buoyant effects of escaping diffused gases in carbonated drinks.

BACKGROUND OF THE INVENTION

Certain drinking apparatus are known which are designed to make the consumption of various types of beverages, including carbonated beverages, more convenient. Representative examples of such apparatus are disclosed in U.S. Pat. Nos. 214,617; 1,253,579; 2,613,107; 3,099,565; and 5,038,476. Typically, such drinking apparatus have been used, for example, to automatically "float" a straw (which is enclosed in a drinking container) to the beverage surface for convenient access when the beverage container is opened (such as by removal of a bottle cap, for example). Other examples of known drinking apparatus include straws with integrated spoons, straws with mixing or swirling devices, and straws with check valves for fluid control or regulation.

Although, as evidenced by the above referenced patents, various types of apparatus have been invented in the past to render the process of drinking a beverage through a straw (or other tubular apparatus) more convenient, no known device or system has addressed the problem of the buoyant effect of escaping gases in carbonated beverages. In particular, a typical straw when placed in a carbonated beverage will not remain at the bottom of the glass (or other drinking container) where the beverage is most conveniently and efficiently withdrawn but will float to the surface and, at times, fall out of the glass. Such a floating straw is inconvenient in that its use requires that at least one hand be occupied in holding the straw at the desired location e.g. at the bottom of the glass. In addition, in a highly carbonated beverage, for example, a straw will often float very rapidly to the surface of the beverage and the straw will fall out of the glass causing beverage to spill on the person holding the beverage container, the table, or other surface (e.g. causing stains etc.).

In view of the above, it is apparent that there exists a need in the art for a drinking apparatus which is capable of anchoring itself against the buoyant effects of escaping gases in drinking beverages. It is a purpose of this invention to fulfill this need in the art, as well as other needs which will become apparent to the skilled artisan once given the following disclosure.

SUMMARY OF THE INVENTION

Generally speaking, this invention fulfills the above-described needs in the art by providing: a drinking apparatus comprising:

- a tubular member for consumption of a beverage having a first diameter; and
- a weight located proximal the length of the tubular member and provided for anchoring one end of the tubular member at a desired location in a beverage container containing a liquid beverage.

IN THE DRAWINGS

Figure 4:
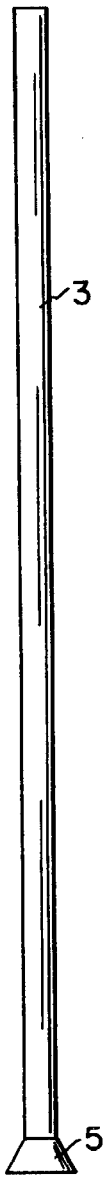
FIG. 4 is a side view of an embodiment of a straw according to the subject invention.
Figure 4A:
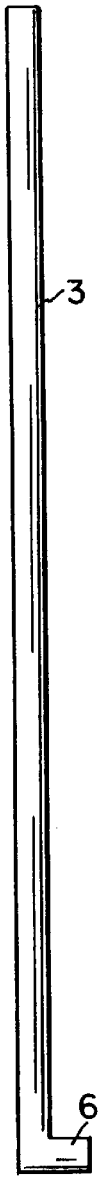

FIG. 4*a* is a side view of an alternative embodiment of a straw according to the subject invention.

Figure 5:
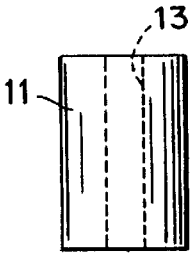
Figure 3:
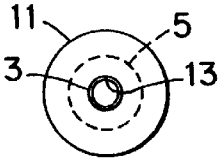
FIG. 3 is a top view of the embodiment illustrated in FIG. 2.

FIG. 5 is a side view of an embodiment of a weight according to the subject invention.

Figure 6:
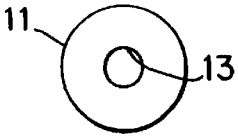

FIG. 6 is a top view of the embodiment illustrated in FIG. 5.

Figure 7:
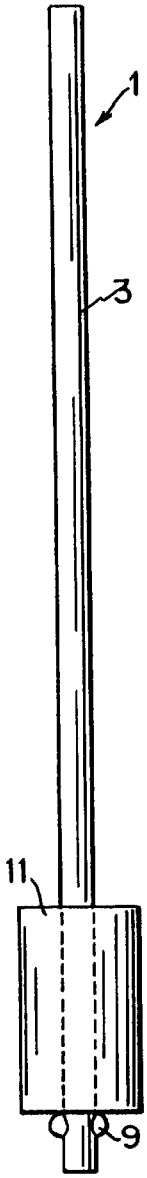

FIG. 7 is a side-view of an alternative embodiment of the drinking apparatus of the present invention.

Figure 8:
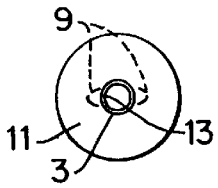

FIG. 8 is a top view of the embodiment illustrated in FIG. 7.

Figure 2:
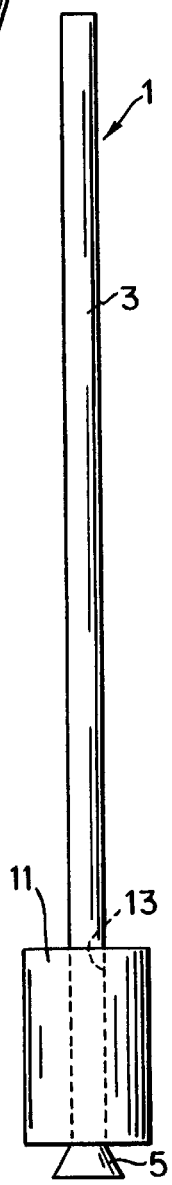
FIG. 2 is a side view of an embodiment of the drinking apparatus of the present invention.
Figure 9:
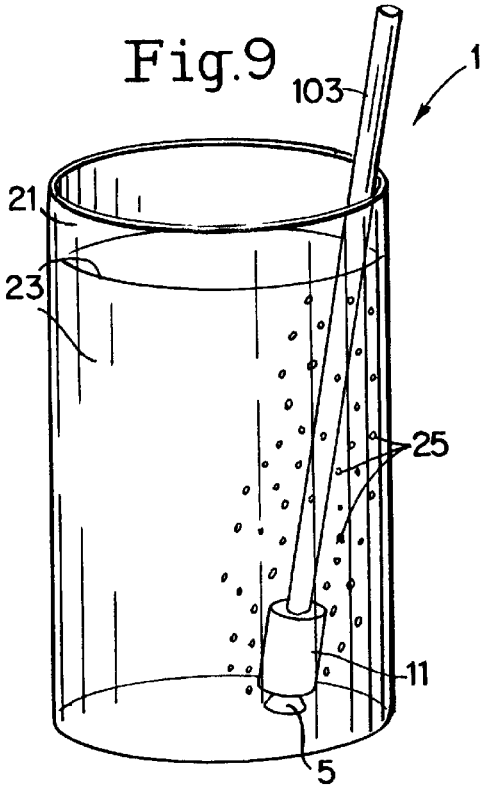

FIG. 9 is a 3-dimensional view of the embodiment of FIG. 2 shown in use in a drinking glass.

Figure 10:
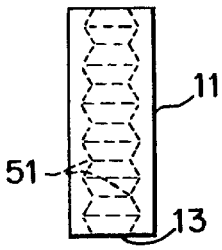

FIG. 10 is a side-plan view of an embodiment of a weight according to the subject invention.

Figure 11:
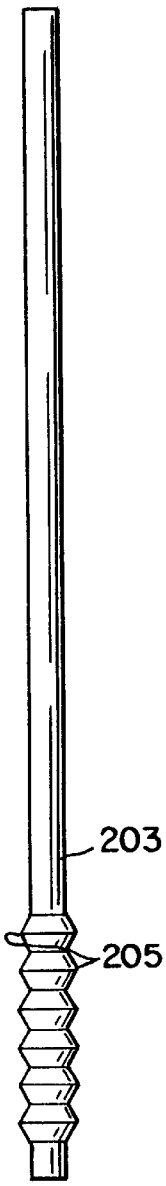

FIG. 11 is a side-plan view of a conventional flex-type straw.

Figure 12:
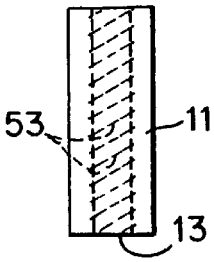

FIG. 12 is a side-plan view of an embodiment of a weight according to the subject invention.

Figure 13:
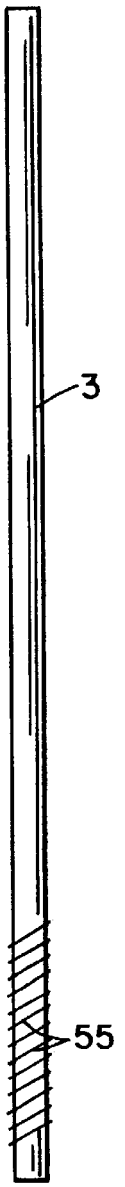

FIG. 13 is a side-plan view of an embodiment of a straw according to the subject invention.

Figure 13A:
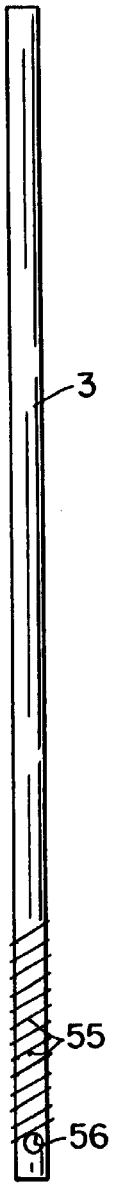

FIG. 13*a* is a side-plan view of an alternative embodiment of FIG. 13.

Figure 14:
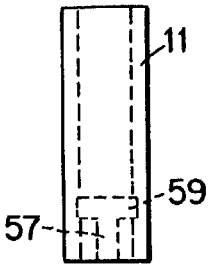

FIG. 14 is a side-plan view of an embodiment of a weight according to the subject invention.

Figure 15:
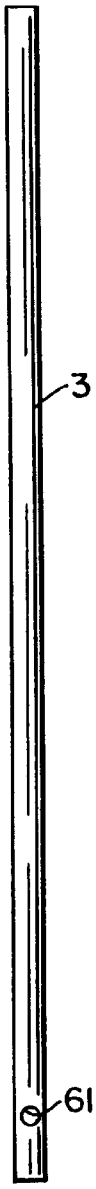

FIG. 15 is a side-plan view of an embodiment of a straw according to the subject invention.

Figure 16:
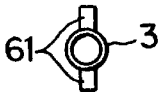

FIG. 16 is a top view of the embodiment of FIG. 15.

DETAILED DESCRIPTION OF CERTAIN EMBODIMENTS

Figure 1:
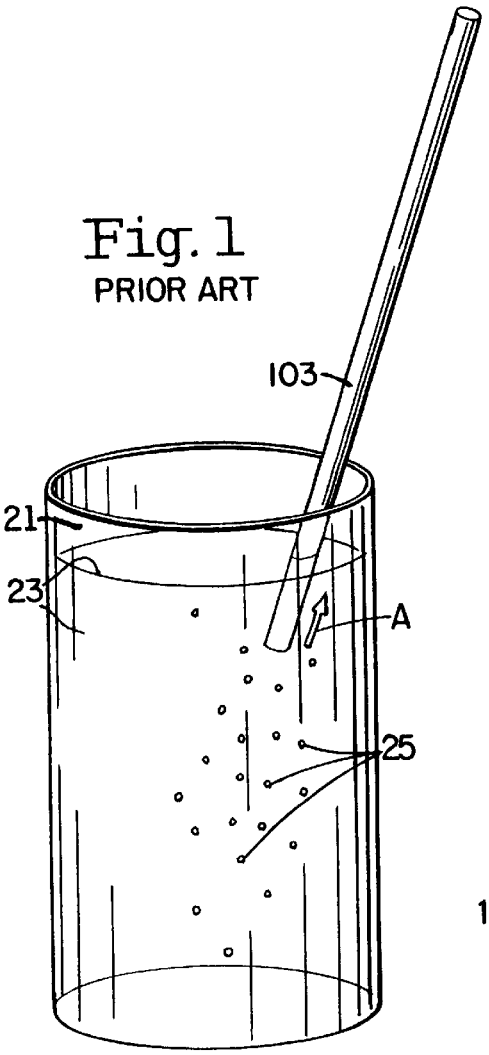
Fig. 1 PRIOR ART
FIG. 1 is a 3-dimensional view of a prior art drinking straw shown in typical known use.

Referring initially to FIG. 1, there is illustrated a prior art straw 103 in typical use in drinking glass 21 filled with carbonated beverage 23. Also illustrated, escaping from beverage 23, are gas bubbles 25 which form as a result of the depressurization of the liquid e.g. when a beverage container is opened. As gas bubbles 25 escape, these bubbles have a cumulative buoyant effect on prior art straw 103 which causes the straw to float upwards from the bottom of the glass in a direction as indicated by arrow "A". This results in straw 103 being inappropriately positioned for ease of use (by a person intending to drink beverage 23). In addition, in some cases, beverage 23 may be so carbonated such that straw 103 is pushed completely out of beverage 23 and glass 21. When this happens, liquid (i.e. beverage 23) is often spilled onto the person drinking from the glass or onto the serving surface (such as onto a serving tray or table). In order to avoid such occurrences when utilizing prior art straw 103, it is necessary for the user of the straw to manually hold straw 103 at the desired location within the drinking glass (e.g. usually at the bottom of the glass).

Referring now to FIGS. 2–9, a solution to the aforementioned prior art problem is therein illustrated. In particular, these figures illustrate weighted drinking apparatus 1 of the present invention. More specifically, weighted drinking apparatus 1 generally includes weight 11 (as shown in both top and profile views in FIGS. 5–6) and straw 3 (or other tubular member suitable for drinking) with flared end 5 which is a diameter that is greater than that of the main portion of the length of straw 3. Weight 11 may be any mass which has a density greater than that of the beverage to be consumed and which includes aperture 13 for insertion of a tubular member therethrough (i.e. straw 3 in the present embodiment). In order to assemble weighted drinking apparatus 1, straw 3 is inserted through aperture 13 of weight 11, and weight 11 is supported about straw 3 by a surface of flared end 5. In order to ensure that weight 11 will be adequately supported, flared end 5 is, of course, greater in diameter than the inside diameter of aperture 13. This area of greater diameter (of flared end 5) is the surface on which weight 11 is supported. In one alternative embodiment of the subject invention illustrated in FIG. 4*a,* straw 3 may simply incorporate a bend in its structure (i.e. an area generally perpendicular to the length of the straw) or series or combination of bends so as to create a surface for weight 11 to rest thereon. Such a surface is exemplified as horizontal portion 6 (FIG. 4*a*) which results from a single bend in straw 3.

In order to thereafter use the unique drinking apparatus of the present invention, weighted drinking apparatus 1 may be inserted in a container (i.e. drinking glass 21) and used to imbibe beverage 23 in a typical manner (as illustrated in FIG. 9). However, as shown in FIG. 9 and unlike straw 103 of the prior art, the mass of weight 11 now anchors straw 3 at a more convenient position at the bottom of the drink container (thus freeing up a hand which would otherwise be used to secure straw 3).

Although straw 3 is illustrated with flared end 5 as a supporting member in the present embodiment, numerous other embodiments of straw 3 are contemplated which are within the scope of the subject invention. In this regard, any embodiment of straw 3 which is capable of retaining weight 11 (or other weight) will serve the purposes of this invention. In some embodiments, straw 3 is simply provided with a portion on its wall (e.g. such as a ridge, or a flap or series of flaps) which protrudes to a distance beyond the outside diameter of straw 3 (and has an effective diameter greater than that of aperture 13) such that weight 11 will be supported thereon. As an example, an embodiment of straw 3 which utilizes an alternative to flared end 5 is illustrated in FIGS. 7 and 8.

Referring now to FIGS. 7 and 8, therein is illustrated two semi-spherical members 9 protruding from the cylindrical wall of straw 3 (shown inserted through weight 11). Specifically, these semi-spherical members 9 each extend a specific distance beyond the outside diameter of the cylindrical outer wall of straw 3 such that these members are capable of retaining weight 11. An example of such a distance is 3/32th of an inch (on each side) on a ¼ inch diameter straw. This gives the area where semi-spherical members 9 are located an effective diameter of $7/16^{th}$ of an inch. If aperture 13 has an inside diameter of $5/16^{th}$ inch, the $7/16^{th}$ inch effective diameter at semi-spherical members 9 ensures that weight 11 will not fall from the end of straw 3 (i.e. because weight 11 cannot pass a $7/16^{th}$ inch diameter section with only a $5/16^{th}$ inch aperture 13). Although these measurements are illustrative of the general concept of the present invention, they are not meant to be limiting, and any combination of diameters which is effective to retain weight 11 at an appropriate location on straw 3 will suffice.

Although weight 11 is illustrated in a generally cylindrical shape with an aperture through its center, weight 11 may be of any shape or construction which otherwise accomplishes its specific purpose (i.e. to bias straw 3 against the buoyancy forces of the beverage as shown in FIG. 9). An example of such an alternative construction (not shown) includes an inner rubber (or other material) ring for securing weight 11 along the length of straw 3. In such an embodiment, the areas of increased diameter (e.g. flared end 5) on straw 3 are not needed because the friction of the rubber ring secures weight 11 on straw 3. In some preferred embodiments, weights 11 are of ornamental construction (e.g. shaped as an automobile) or contain advertising information such as corporate logos or a proprietor's name, monogram, crest or other identifying information. Although weight 11 may be fashioned in any shape and composed of any safe and non-toxic material which is more dense than the beverage to be consumed, the coefficient of expansion of the material used should be taken into account when determining the size of aperture 13 (so that straw 3 will fit easily therethrough at all normal operating temperatures).

In an alternative embodiment of the subject invention, illustrated in FIG. 10, there is provided a weight 11 with internal "teeth-like" ridges 51 built in to the circumference of its aperture 13 (the ridges comprising both "peaks" and "valleys"). Specifically, these ridges 51 permit weight 11 to be affixed to a conventional flex-type (shown as 203 in FIG. 11) straw without any modification to the straw itself (alternatively however, specifically sized ridges, large or small, may be manufactured into straws where such sized ridges are desirable for effectively engaging with alternatively sized ridges 51). Such a flex-type straw 203 contains an accordion-like flexible structure comprised of ridges 205 (also with "peaks" and "valleys") which allow straw 203 to be bent into various configurations. In particular, ridges 51 of the embodiment of FIG. 10 are complementary to ridges 205 normally found on conventional flex straw 203. Therefore, when the subject embodiment of weight 11 is inserted upon straw 205, the two sets of ridges will match-up (e.g. with a peak resting inside each valley) and effectively secure weight 11 proximal the end of straw 203 (thus enabling it for use as hereinabove described).

Referring now to FIGS. 12 and 13, there is illustrated yet another embodiment of the subject invention. Specifically, FIG. 12 illustrates weight 11 with internal threads 53 within its aperture 13. In this embodiment, straw 3 (FIG. 13) contains threads 55 which are complementary to threads 53 of weight 11. Therefore, in order to secure weight 11 to an appropriate portion of this embodiment of straw 3, weight 11 need only be threaded on to threads 55 (e.g. by inserting straw 3 through aperture 13 and twisting the weight 11 onto threads 55) in order to ready it for use as a weighted drinking system. In one exemplary embodiment illustrated in FIG. 13*a,* stop pin 56 (or a pair of stop pins) may be utilized in order to prevent weight 11 from falling from the bottom end or portion of straw 3 (i.e. the portion of straw 3 inserted into a drink).

In still a further embodiment of the subject invention, straw 3 (FIG. 15) may be provided with locking pins 61 extending from its structure. These pins are designed to fit within specially designed channels 57 built-in to an embodiment of weight 11 illustrated in FIG. 14. Channels 57 extend vertically from the bottom portion of weight 11 until they reach horizontally extending portion or channels 59. When weight 11 is inserted over the tubular structure of the present embodiment of straw 3, weight 11 may be turned so that locking pins 61 match up with vertical channels 57. This will allow locking pins 61 to travel the full vertical length of channels 57 at which point locking pins 61 will be located at the beginning of channels 59. Thereafter, in order to "lock" weight 11 in place on straw 3, weight 11 need only be manually twisted so that locking pins 61 are moved in to place inside the confines of channels 59. Once in place, (this embodiment of) weight 11 will be secured and capable of providing the aforementioned functions herein described in the specification.

Although carbonated beverages are used as an illustrative example herein and tend to be comparatively buoyant, many other types of drinking beverages produce similar buoyancy forces thus resulting in the same prior art problems. As such, applicant does not restrict the use of his invention to that of carbonated beverages.

Once given the above disclosure, many other features, modifications, and improvements will become apparent to the skilled artisan. Such other features, modifications, and improvements are therefore considered to be part of this invention, the scope of which is to be determined by the following claims:

We claim:

1. A drinking apparatus comprising:

a tubular member for consumption of a beverage therethrough, said tubular member having a first end and second end, said first and second ends being non-fixedly located;

a weight comprised of a substantially non-soluble material and having an aperture for insertion of said tubular member therethrough;

said weight being located between said first and second ends of said tubular member, said weight further being located at a distance offset from said second end of said tubular member such that when said drinking apparatus is placed in a drinking vessel containing a liquid beverage, said second end of said tubular member will be anchored by the mass of said weight, such that said second end of said tubular member will be in contact with a bottom surface of the drinking vessel; and wherein said weight is accessible and both removable and installable by a user of said drinking apparatus.

2. The drinking apparatus of claim 1 wherein said tubular member has a first diameter; and wherein said tubular member further includes a retaining member located proximal the length of said tubular member, between said first and second ends of said tubular member, and at a distance offset from said second end of said tubular member;

wherein said retaining member has a second diameter greater than said first diameter.

3. The drinking apparatus of claim 2 wherein said aperture of said weight has a third diameter which is greater than said first diameter but is less than said second diameter.

4. The drinking apparatus of claim 3 wherein said weight is of a sufficient mass and density to anchor said second end of said tubular member at a desired location in said drinking vessel containing the liquid beverage.

5. The drinking apparatus of claim 1 wherein said second end of said tubular member protrudes at least a distance from said aperture of said weight such that said second end of said tubular member is positionable in corners of said drinking vessel without interfering contact of said weight with a side or the bottom surface of said drinking vessel.

6. The drinking apparatus of claim 1 wherein said tubular member includes flexible ridges on at external surface and wherein said aperture includes ridges about the circumference of said aperture and wherein said flexible ridges and said ridges of said aperture are so sized such that said weight is securable to said tubular member by inserting said tubular member through said aperture thereby matching said flexible ridges to said ridges of said aperture.

* * * * *